US008561721B2

(12) United States Patent
Tjader

(10) Patent No.: US 8,561,721 B2
(45) Date of Patent: Oct. 22, 2013

(54) DRILL HEAD CONNECTION

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 460 days.

(21) Appl. No.: 12/021,523

(22) Filed: Jan. 29, 2008

(65) Prior Publication Data

US 2008/0210468 A1 Sep. 4, 2008

Related U.S. Application Data

(60) Provisional application No. 60/887,100, filed on Jan. 29, 2007.

(51) Int. Cl.
*E21B 47/01* (2012.01)

(52) U.S. Cl.
USPC ..... 175/40; 175/320

(58) Field of Classification Search
USPC ..... 175/61, 62, 40, 320, 50, 325.1
See application file for complete search history.

(56) References Cited

U.S. PATENT DOCUMENTS

| | | | | |
|---|---|---|---|---|
| 1,121,386 | A * | 12/1914 | Means | 277/622 |
| 3,933,210 | A * | 1/1976 | Skidmore | 173/132 |
| 4,907,658 | A * | 3/1990 | Stangl et al. | 175/19 |
| 6,260,634 | B1 * | 7/2001 | Wentworth et al. | 175/61 |
| 6,263,983 | B1 * | 7/2001 | Wentworth et al. | 175/19 |
| 6,311,790 | B1 * | 11/2001 | Beckwith et al. | 175/62 |
| 6,581,680 | B1 * | 6/2003 | Wentworth | 166/65.1 |
| 2004/0040751 | A1 * | 3/2004 | Falvey et al. | 175/415 |
| 2008/0185187 | A1 * | 8/2008 | Scott et al. | 175/320 |

* cited by examiner

*Primary Examiner* — Kenneth L Thompson
*Assistant Examiner* — James Sayre
(74) *Attorney, Agent, or Firm* — Schwegman Lundberg & Woessner, P.A.

(57) ABSTRACT

A drill head system and method of use is shown. Drill head systems shown provide for a secure drill head connection to a cylindrical portion or sonde housing, while still allowing for easy removal of a drill head without using pipe wrenches, breaker bars, etc. An internal fastener further provides easy assembly and disassembly of the drill head by protecting components from dirt or other debris. A tapered connection with male and female fittings are shown in one example that further provide a robust joint between components such as a drill head and a sonde housing.

14 Claims, 9 Drawing Sheets

DRILL HEAD CONNECTION

RELATED APPLICATIONS

This patent application claims the benefit of priority, under 35 U.S.C. Section 119(e), to U.S. Provisional Patent Application Ser. No. 60/887,100, filed on Jan. 29, 2007, which is incorporated herein by reference.

TECHNICAL FIELD

This invention relates to drill stem devices and methods of connection. Specifically, this invention relates to devices and methods for coupling and decoupling drill heads to sonde housings for use with horizontal directional drills.

BACKGROUND

Directional drilling is a useful technique for several procedures such as utility installation, etc. One common type of directional drilling is horizontal directional drilling (HDD), where a drill stem is extended essentially horizontally to form passages underground without the need for a trench. Drill heads in directional drilling typically have a feature which causes the drill head to steer in one direction when forced ahead by a drilling device. During a boring operation, pressure is applied through a drill stem from behind to the drill head. During a straight bore, the drill stem is typically rotated at a regular rate so that on average, only straight ahead drilling is accomplished. In order to steer a drill head, the rotation is temporarily stopped, and the drill head is allowed to steer in the desired direction. Once the steering maneuver is complete, the drill head is again rotated at a regular rate for straight ahead drilling.

In many HDD operations, an electronic transmitter called a sonde is coupled to a distal end of the drill stem. Signals transmitted from the sonde are detected by a receiver carried by an operator above ground. Various characteristics of the detected signal are then used to indicate a location and orientation of the distal end of the drill stem. This information can then be used to steer the drill stem in a desired direction.

When a bore is completed, typically the sonde and associated sonde housing are removed and a pipe, cable, transmission line. etc. is coupled to the drill stem to be pulled into the bore as the drill stem is pulled back. A common attachment between components such as the sonde housing and the drill stem is a threaded connection such as a tapered thread as known in the industry. Currently large pipe wrenches are sometimes used to loosen the threaded connection at the sonde housing, however use of large pipe wrenches within an exit pit of a horizontal bore presents a level of safety risk. Large torque forces can be necessary to loosen the threaded joint which can make breaking the connection difficult. Additionally, sonde housings and drill heads are expensive to manufacture. Because multiple configurations of drill heads are typically needed to address varying soil conditions, there is an ongoing need in the field to reduce costs for the collection of drill equipment needed. What is needed is an improved drill system and method that makes connection and disconnection of drill stem components easier, improves safety, reduces cost, etc.

DETAILED DESCRIPTION

Figure 1:
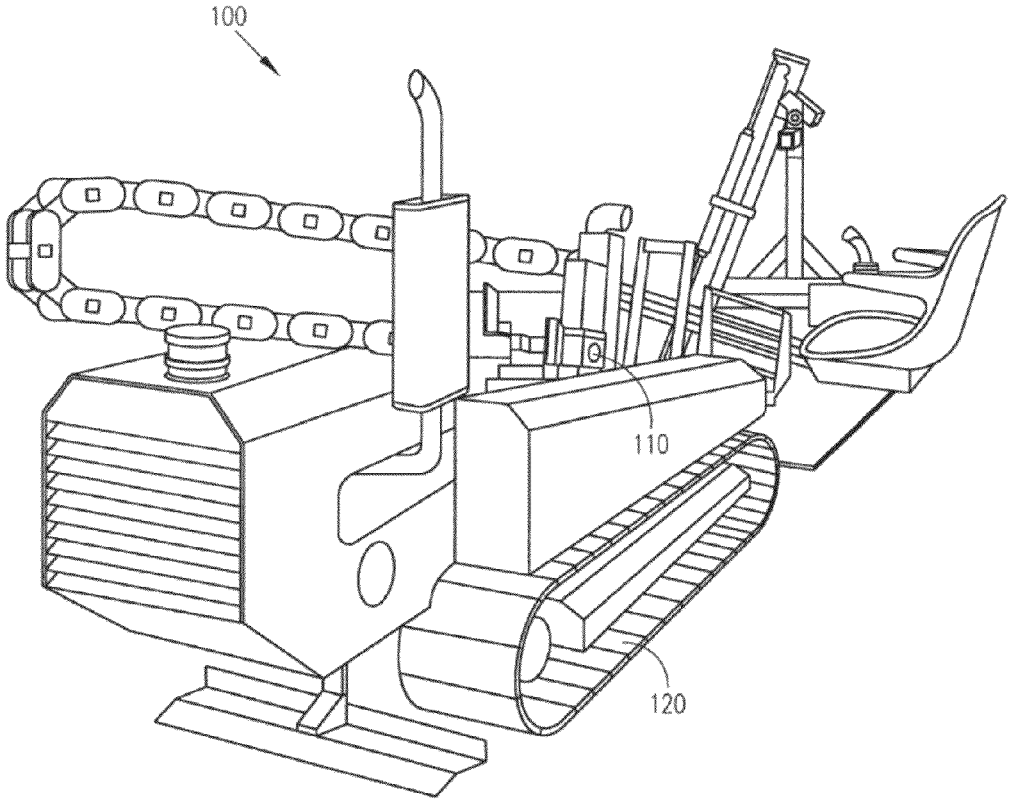
FIG. 1 shows an example of a horizontal directional drill using components according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, mechanical or logical changes, material choice, etc. may be made without departing from the scope of the present invention.

In the following description the term "breaking" unless otherwise noted refers to an operation of loosening a threaded connection where higher levels of starting friction forces are overcome, and lower sliding friction forces are then required to finish unscrewing a threaded connection. Unless otherwise noted, "breaking" does not refer to actually damaging any component.

In the following description, the term "spline" is defined as an engaging feature that fits into a slot. As defined, a spline may be integrally formed along with another component, or it may be separate, such as a key that is replaceable. Although typically a spline is machined from a bulk metal such as steel, other structures such as commercially available pins, bolts, etc. are included in the present definition of spline, provided they interface with a slot or other opening to prevent rotation as described in more detail below.

FIG. 1 shows an example of a drilling device that includes and/or is capable of using components of the present invention. As discussed above, although an example of a directional drill 100 is used in the following descriptions, other ground drills utilizing a number of sections of drill stem are also contemplated to be within the scope of the invention. The directional drill 100 of FIG. 1 is shown on a track system 120 for positioning the directional drill 100. Although a track system 120 is shown, other systems are also possible for use in positioning the directional drill 100. Wheeled systems, or combinations of tracked and wheeled systems are examples of acceptable positioning systems. Although a positioning system is shown in the embodiment of FIG. 1, the invention is not so limited. Embodiments without a positioning system are also possible.

A drilling drive block 110 is shown on the directional drill 100. The drilling drive block 110 is used to rotate a drill stem and to advance the drill stem during a drilling operation. Advancement of a drill stem is typically linear. In the example of a directional drill 100, the advancement of the drill stem is also typically at an angle of incidence to the ground as shown in FIG. 1.

Figure 2:
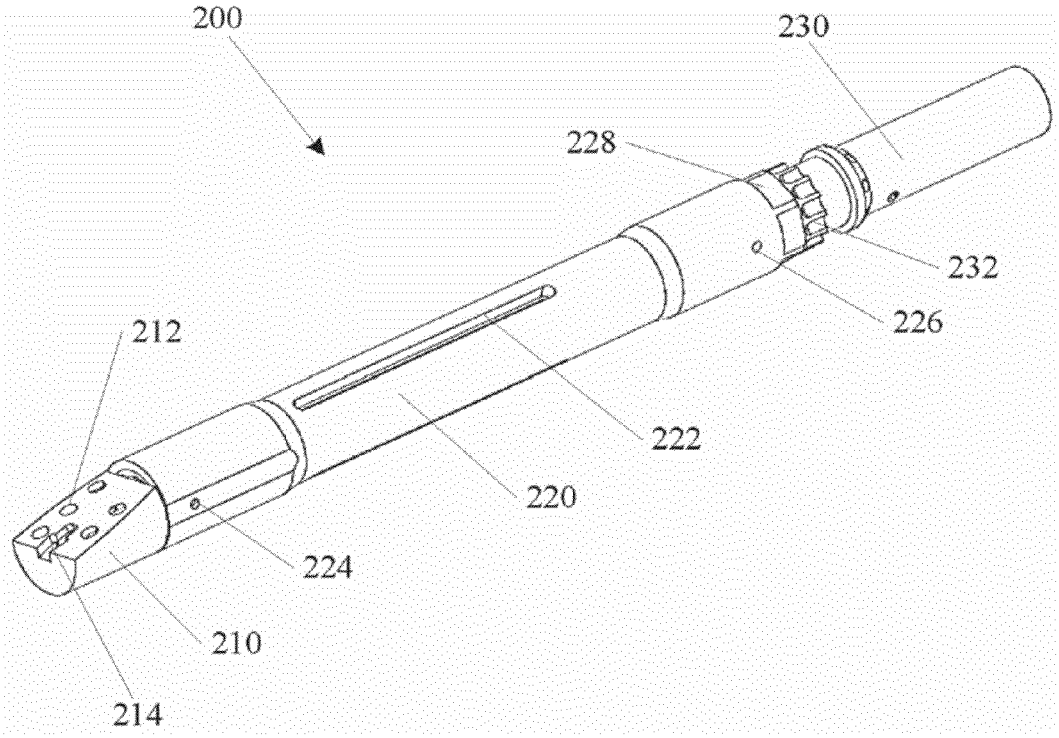
FIG. 2 shows front end components of a drill string according to an embodiment of the invention.

FIG. 2 shows a drill head system 200. A drill head 210 is shown attached to a cylindrical portion 220 which is in turn coupled to a starter shaft 230. The cylindrical portion 220 includes a sonde cavity within the cylindrical portion 220 to accept a sonde. Radio transparent windows 222 such as epoxy filled, etc. are shown to emit the sonde signal for location and steering purposes.

The drill head 210 shown is adapted for a spoon bit (not shown). A number of threaded holes 212 are shown to secure a flat blade bit to the drill head 210. Also shown is a pocket 214 to accept a drill fluid nozzle (not shown). In one embodiment, a fluid passage is included in a wall of the cylindrical portion 220 to transmit drill fluid from the drill string, through the starter shaft 230, through the cylindrical portion 220, and into the drill head 210. A first plugged hole 224 and a second plugged hole 226 are features of the fluid passage that are discussed in more detail below under FIGS. 5A and 5B.

In one embodiment, the connection between the cylindrical portion 220 and the starter shaft 230 includes a tapered thread. The tapered thread 234 of the starter shaft 230 is visible in FIG. 3. FIG. 2 shows a number of wrench flats 228 located on the cylindrical portion 220, and a number of splines 232 located on the starter shaft 230. To disconnect the cylindrical portion 220 from the starter shaft 230, a tool for example as described in co-pending application 60/863,073 which is incorporated by reference, engages the flats 228 and the splines 232 and counter-rotates the cylindrical portion 220 against the starter shaft 230 to break the threaded connection. The same tool as described in co-pending application 60/863,073 can be used to connect the joint if desired. A tapered thread connection is desirable because it is a proven robust and secure drill string joint. By using the tool described in co-pending application 60/863,073, the joint between the starter shaft 230 and the cylindrical portion 220 are also removable without the use of pipe wrenches or breaker bars, etc. that present a higher level of safety risk.

Figure 3:
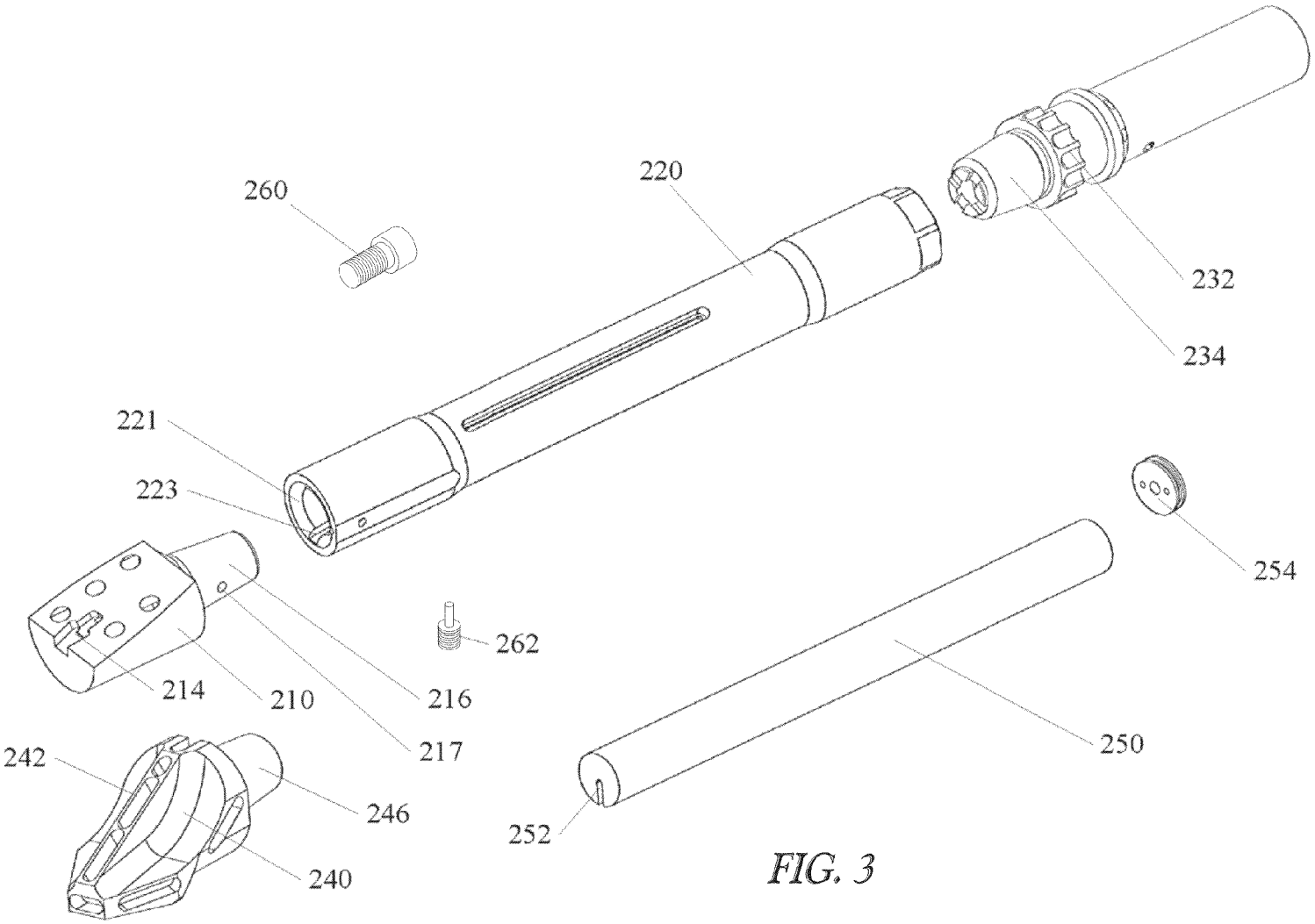
FIG. 3 shows components from FIG. 2 in an exploded configuration according to an embodiment of the invention.

FIG. 3 shows an exploded view of drill head system 200 components from FIG. 2. The drill head 210 is shown with a male fitting 216 protruding from an attachment end. The male fitting corresponds to a female fitting 221 located on the adjacent cylindrical portion 220. In one embodiment, as shown, the male fitting includes a taper that matches a corresponding taper in the female fitting 221. A taper feature provides increased joint strength by centering the male fitting 216 within the female fitting 221. A large area of contact between the male fitting 216 and the female fitting 221 is also provided. The joint connection in such a tapered arrangement is more stable that that provided with a straight cylindrical fitting. Although FIG. 3 shows the male fitting 216 located on the drill head 210, and the female fitting 221 located on the cylindrical portion 220, one of ordinary skill in the art, having the benefit of the present disclosure will recognize that the male and female fittings could be reversed.

A slot 223 is shown within the cylindrical portion 220 adjacent to where the drill head 210 is adapted to mount. FIG. 3 shows the slot 223 located within a side portion of the female fitting 221. In one embodiment, a spline engages the slot 223 to resist torque forces and prevent rotation of the drill head 210 relative to the cylindrical portion 220. Although a single slot 223 or groove is shown in FIG. 3, the invention is not so limited. A plurality of splines and grooves are also within the scope of the invention. In one embodiment, multiple splines and grooves are spaced around a periphery of the male fitting 216 and the female fitting 221. The term "spline" is used in a general sense as defined above, and is intended to encompass a number of configurations that prevent rotation by engaging a groove or other opening.

An optional rock drill head 240 is also shown in FIG. 3 as an alternative to the flat blade drill head 210. A number of pockets 242 to accept carbide inserts are shown. The rock drill head 240 includes a male fitting 246 that is substantially the same as the male fitting 216 of the flat blade drill head 210. The rock drill head 240 is therefore interchangeable with the flat blade drill head 210. In this way, the cylindrical portion 220 need only be purchased once, and a variety of drill heads such as drill head 210 or rock drill head 240 can be used depending on the given soil conditions for drilling. The drill head system is modular, thus providing increased flexibility and reduced product cost.

An internal fastener 260 is shown in FIG. 3. In the embodiment shown, the internal fastener 260 includes a hex head bolt. Other bolts or fasteners are also within the scope of the invention, for example other internal fasteners include pins inserted through corresponding holes, cams, other linkages, etc. As will be shown in more detail below, the internal fastener holds the male fitting 216 against the female fitting 221 from an inside of the cylindrical portion 220. Because the internal fastener 260 is not exposed to the soil during a drilling operation, the fastener 260 is significantly easier to remove than configurations where fasteners are exposed to the soil.

A sonde 250 is shown along side the cylindrical portion 220, with a seal 254. In operation, the sonde 250 is placed within a sonde cavity in the cylindrical portion 220 as shown in more detail in FIGS. 5A and 5B. FIG. 3 illustrates an end loaded sonde arrangement, where the sonde 250 is inserted at the starter shaft end of the cylindrical portion 220. In one embodiment of an end load configuration, the seal 254 is used to keep drill fluid from entering the sonde cavity. Although an end load configuration is shown, the invention is not so limited. Other configurations such as side load sonde housings are also within the scope of the invention. Advantages of end load sonde housings include increased durability and strength due to the substantially continuous outer wall of the cylindrical portion 220.

An alignment pin 262 is also shown in FIG. 3. In one embodiment, a separate alignment pin 262 is used in cooperation with a sonde groove 252 to align the sonde within the sonde cavity. Other configurations use alternative features, grooves, etc. to orient the sonde.

Figure 4A:
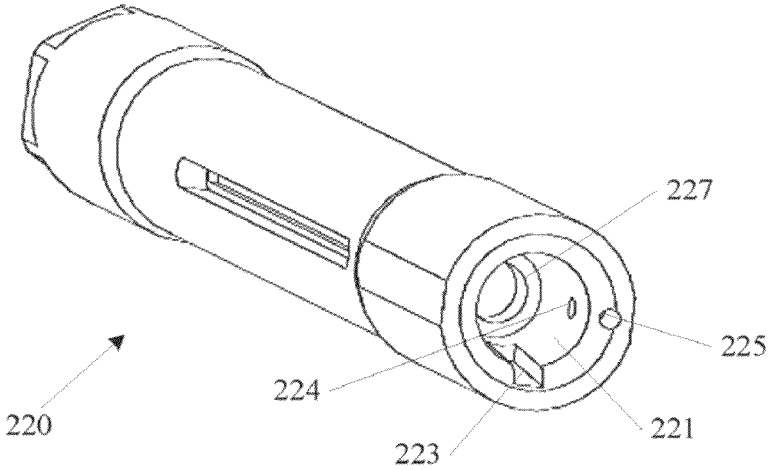
FIG. 4A shows a sonde housing component from FIG. 2 according to an embodiment of the invention.

FIG. 4A shows an end view of the cylindrical portion 220 to better illustrate the female fitting 221 and the slot 223. A machined shelf 227 is shown that cooperated with the internal fastener 260 to secure the drill head 210. Although a shelf 227 is shown other configurations are possible to provide an internal fastening system for the drill head 210. A hole 224 is shown from an internal view in FIG. 4A. The hole 224 is plugged from an outside view as shown in FIG. 2 to provide a portion of a drill fluid passage. A second hole 225 is also shown to provide a portion of the drill fluid passage as further shown in FIGS. 5A and 5B.

Figure 4B:
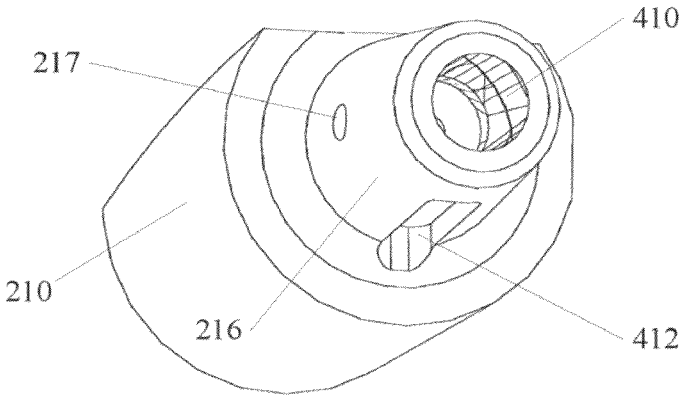
FIG. 4B shows a drill head from FIG. 2 according to an embodiment of the invention.

FIG. 4B shows the drill head 210 with the end of the male fitting 216 visible. A second slot 412 is shown in the male fitting 216. In one embodiment, a key is inserted into the slot 412 and also into the slot 223 of the cylindrical portion 220. The key prevents rotation between the drill head 210 and the cylindrical portion 220. An advantage of a key over other spline configurations includes the ability to replace a damaged key. Threads 410 are shown in the male fitting 216 to accept an internal fastener 260 such as a hex head bolt.

A hole 217 that corresponds to hole 224 is shown on the male fitting 216. In operation, drill fluid passes from the cylindrical portion 220 into the drill head 210 through the hole 217, and is transmitted out to a nozzle. By transmitting fluid into a side of the male fitting 216, a number of expensive gun drill operations is reduced in manufacturing. For example, hole 225 is long, and typically requires a special gun drilling operation. In the configuration shown in the present Figures, only one gun drill operation is necessary.

Figure 5A:
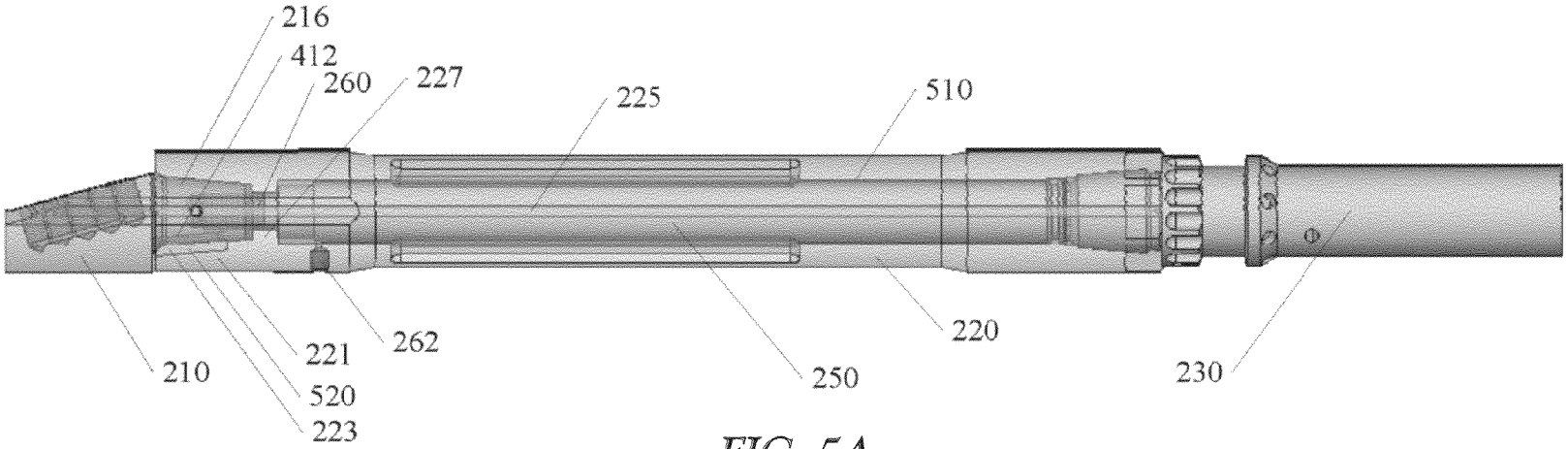
FIG. 5A shows a side view of front end components of a drill string according to an embodiment of the invention.

FIG. 5A shows a drill head system in an assembled state, with a number internal components visible. For example, the sonde 250 is seen located in the sonde cavity 510 within the cylindrical portion 220. The alignment pin 262 is shown engaging the slot 252 of the sonde 250. The male fitting 216 is shown engaged with the female fitting 221. The slot 223 and the slot 412 are shown aligned with each other, and held in position by a key 520. The internal fastener 260 is shown pulling the male fitting 216 into the female fitting 221. The internal fastener is also shown butting up against the shelf 227. As can be seen from FIG. 5A, the internal fastener 260 is contained within the sonde cavity 510, and is protected from any dirt or debris that would be encountered during a drilling operation.

Figure 5B:
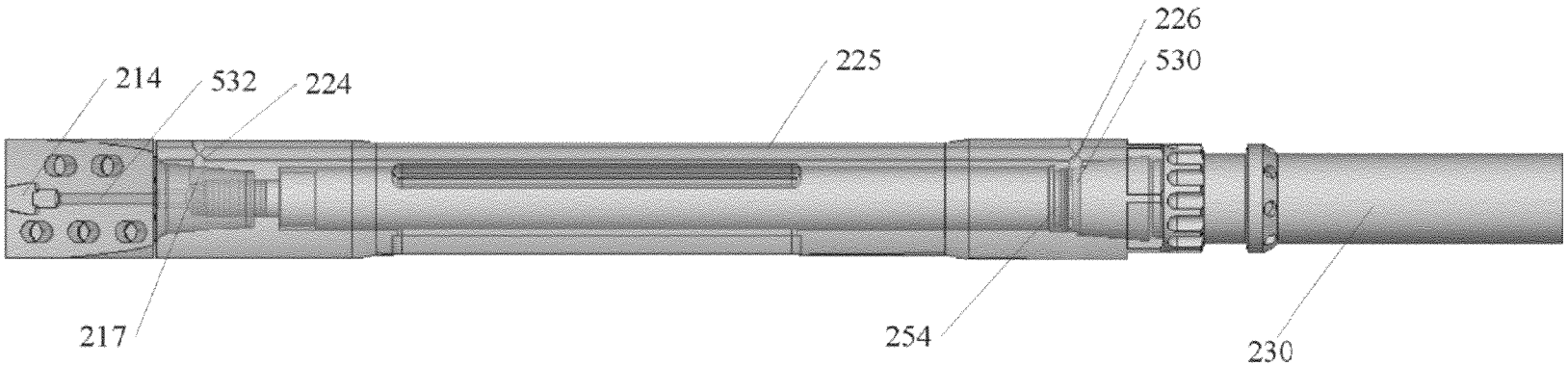
FIG. 5B shows a top view of front end components from FIG. 5*a* according to an embodiment of the invention.

FIG. 5B illustrates the fluid passage for drill fluid. The holes 226, 225, 224, and 217 are shown to provide a path for drilling fluid around the sonde 250. A space 530 is shown between the end of the starter shaft 230 and the seal 254 where drilling fluid exits a center of the starter shaft, and enters the hole 226. In one embodiment, ends of the holes such as 224, 226, 225, etc. are plugged after drilling to create the fluid path. In one embodiment, steel plugs are epoxied, otherwise glued, or welded, etc. in place.

Figure 6:
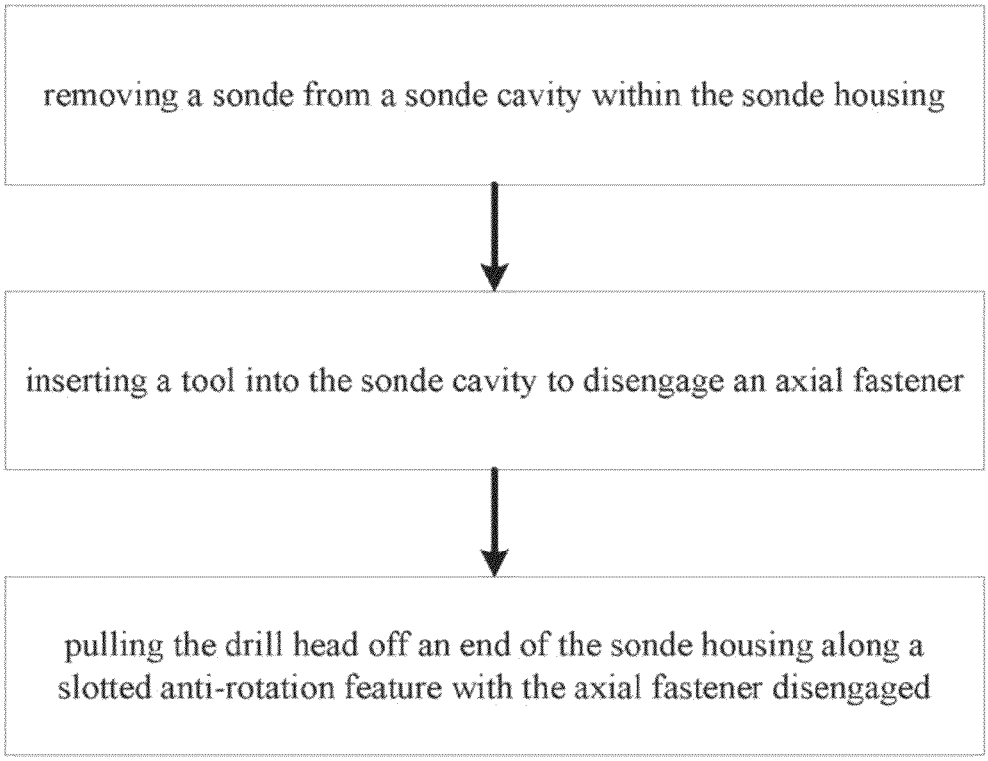
FIG. 6 shows a method of making a bore according to an embodiment of the invention.
Figure 7:
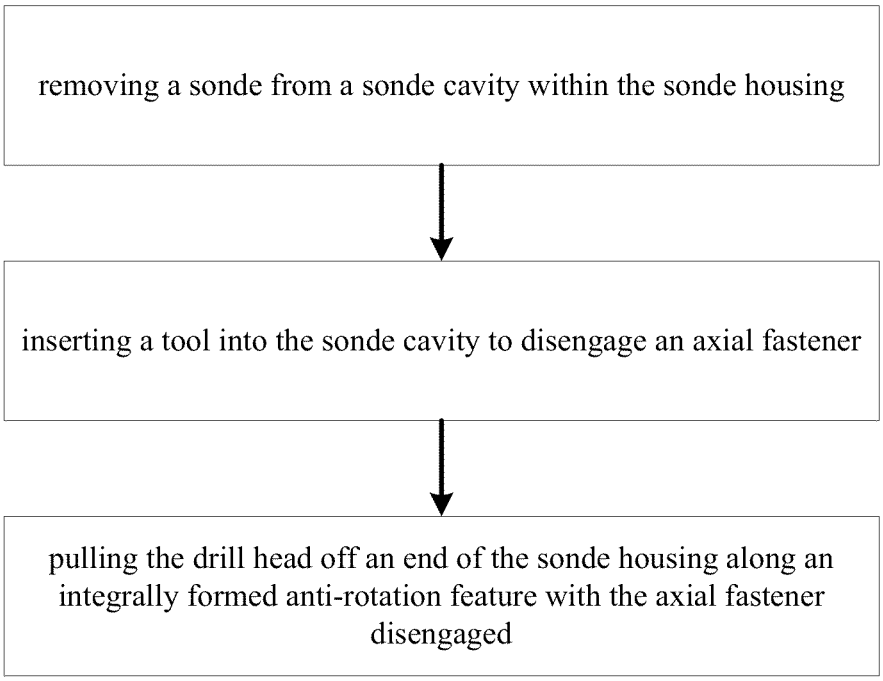
FIG. 7 shows another method according to an embodiment of the invention.
Figure 8:
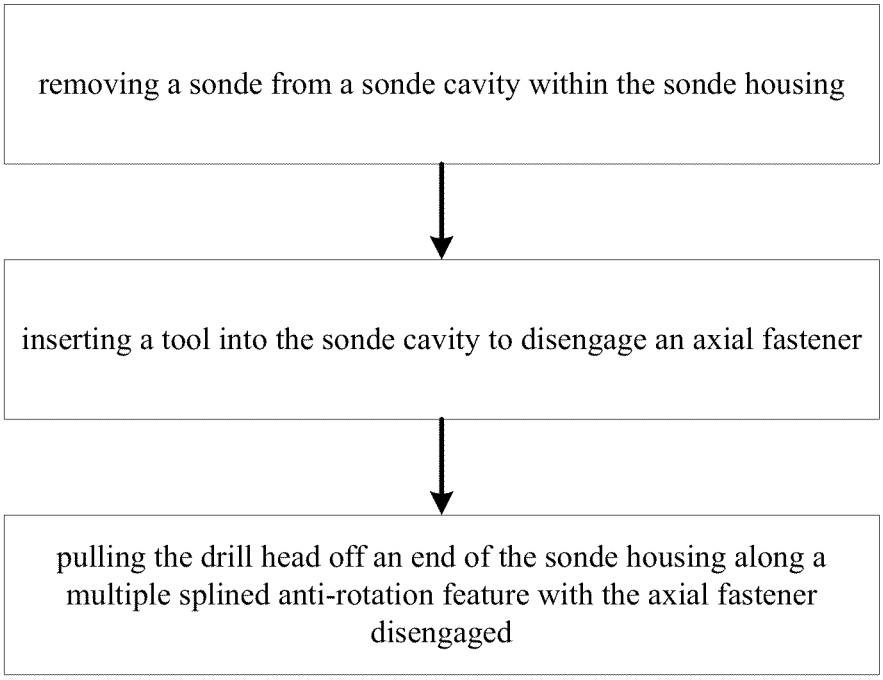
FIG. 8 shows another method according to an embodiment of the invention.
Figure 9:
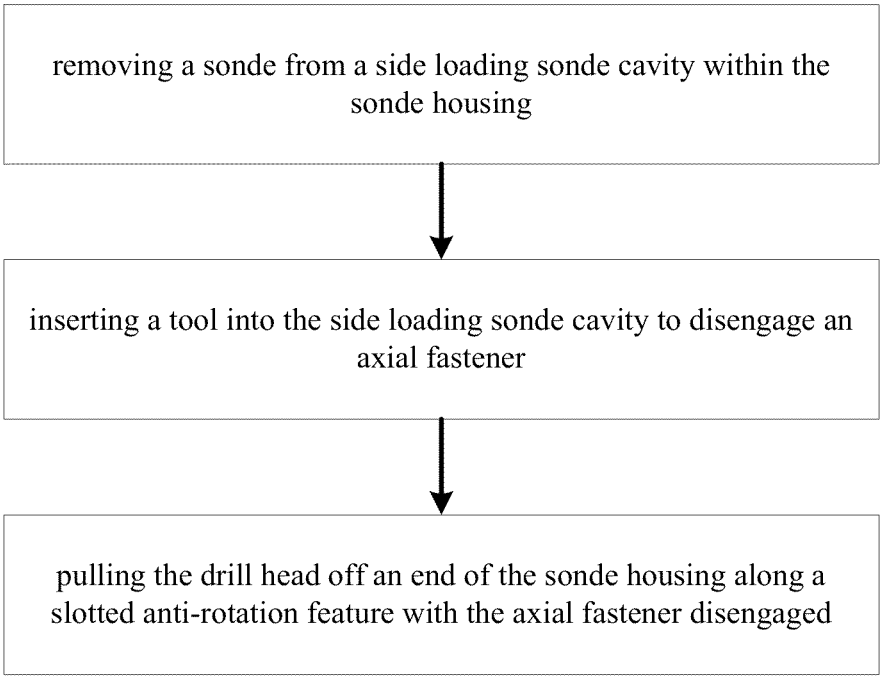
FIG. 9 shows another method according to an embodiment of the invention.

FIG. 6 illustrates an example of a method of removing a drill head. A sonde is first removed from a sonde cavity to provide access to an internal fastener. A tool such as a hex wrench, etc. is then inserted into the sonde cavity to engage the internal fastener. In the case of a hex head bolt, the internal fastener is then unscrewed to disengage the fastener. As illustrated in embodiments above, the internal fastener provides an axial force to bring the male fitting 216 in along the drill axis into the female fitting 221. Axial is used in contrast to rotational, or torque securing such as provided by splines, keys, etc. FIG. 6 further illustrates a step of pulling the drill head off an end of the sonde housing along a slotted anti-rotation feature.

While a number of advantages of embodiments of the invention are described, the above lists are not intended to be exhaustive. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and methods are used. The scope of the invention should be determined with reference to the appended claims, along with the full scope of equivalents to which such claims are entitled.

I claim:

1. A drill head system, comprising:

a cylindrical portion to accept a sonde, the cylindrical portion having a tapered female fitting at a first end;

a removable drill head having a tapered male fitting to engage the female fitting of the cylindrical portion;

a removable sonde alignment pin projecting within a sonde cavity;

a fastening system coupled between the cylindrical portion and the drill head, including:

at least one spline wherein the spline is protected from external debris as a result of the spline being located inside the cylindrical portion, wherein the spline engages both the cylindrical portion and the drill head to resist torque forces; and an internal fastener to axially pull the female fitting and the male fitting together along a drill stem axis, wherein the internal fastener is not exposed to surrounding soil.

2. The drill head system of claim 1, wherein at least one spline is integrally formed in the drill head.

3. The drill head system of claim 1, wherein at least one spline is integrally formed in the cylindrical portion.

4. The drill head system of claim 1, wherein multiple splines engages both the cylindrical portion and the drill head to resist torque forces.

5. The drill head system of claim 1, wherein at least one spline includes a removable key.

6. The drill head system of claim 1, wherein the internal fastener includes a hex head bolt.

7. The drill head system of claim 1, wherein the cylindrical portion includes an end loading sonde housing.

8. The drill head system of claim 1, wherein the cylindrical portion includes a side loading sonde housing.

9. A drill head system, comprising:

a cylindrical portion to accept a sonde, the cylindrical portion having a tapered female fitting at a first end;

a removable drill head having a tapered male fitting to engage the female fitting of the cylindrical portion;

a fastening system coupled between the cylindrical portion and the drill head, including:

at least one key that fits into at least one slot at the interface between the female fitting and the male fitting to prevent rotation between the female fitting and the male fitting wherein the key is not exposed to surrounding soil;

an internal fastener to axially pull the female fitting and the male fitting together, wherein the internal fastener is accessible through an inside of the cylindrical portion.

10. The drill head system of claim 9, wherein the cylindrical portion includes a tapered thread fitting at a second end.

11. The drill head system of claim 9, further including a fluid passage that passes axially through a wall of the cylindrical portion, and transmits fluid to the drill head through an opening in a side of the male fitting.

12. The drill head system of claim 9, wherein the drill head includes a flat blade bit drill head.

13. The drill head system of claim 9, wherein the drill head includes a rock drill head.

14. The drill head system of claim 9, wherein the fastening system includes a first slot in a side surface of the male fitting and a corresponding second slot in a side surface of the female fitting with a replaceable key that prevents relative rotation between the male fitting and the female fitting when the key is engaged in the first and second slots.

* * * * *